United States Patent [19]

Stevens et al.

[11] 4,446,791

[45] May 8, 1984

[54] INK CONTROL FOR A MULTI-CYLINDER STENCIL DUPLICATOR

[75] Inventors: Colin R. Stevens, London; Victor Ababurko, Bishops Stortford, both of England

[73] Assignee: Gestetner Manufacturing Limited, London, England

[21] Appl. No.: 378,245

[22] Filed: May 14, 1982

[30] Foreign Application Priority Data

May 22, 1981 [GB] United Kingdom ..... 8115823

[51] Int. Cl.[3] ..... B41L 13/18; B05C 11/10

[52] U.S. Cl. ..... 101/122; 101/119; 101/DIG. 24; 73/304 C; 118/694; 118/712; 324/61 R; 427/10

[58] Field of Search ..... 101/121, 122, 148, 340, 101/344, 347, 348, 349, 350, 363, 364, DIG. 24, DIG. 26; 73/304 C, 780, 861.14; 100/45, 49; 118/679, 688, 689, 690, 693, 694, 712, 713; 156/64; 324/61 R, 61 P; 427/8, 9, 10

[56] References Cited

U.S. PATENT DOCUMENTS

| | | | |
|---|---|---|---|
| 3,227,951 | 1/1966 | Dykaar | 324/61 R |
| 3,584,579 | 6/1971 | Rothenberg | 101/350 |
| 3,730,086 | 5/1973 | Dauterman | 101/148 |
| 3,847,076 | 11/1974 | Vasilantone | 101/122 |
| 3,857,095 | 12/1974 | Mitchie et al. | 101/349 X |
| 4,253,272 | 3/1981 | Berthess | 324/61 R |
| 4,312,270 | 1/1982 | Gates | 101/122 |
| 4,369,080 | 1/1983 | Johnson | 156/64 |

FOREIGN PATENT DOCUMENTS

| | | | |
|---|---|---|---|
| 55-55869 | 4/1980 | Japan | 101/119 |

*Primary Examiner*—Edgar S. Burr
*Assistant Examiner*—David A. Wiecking
*Attorney, Agent, or Firm*—Fleit, Jacobson, Cohn & Price

[57] ABSTRACT

A multi-cylinder stencil duplicator includes ink-applying means in the form of a coating member offering a fixed nip between the coating member and a cylinder of the duplicator, ink being applied to one side of that nip and being held back as a wedge at the nip during rotation of the duplicator cylinder. The dispensing of ink to the wedge is controlled in response to variations in the capacitance between the coating member and the cylinder, so that when the ink wedge drops below a given threshold value further ink is dispensed.

18 Claims, 11 Drawing Figures

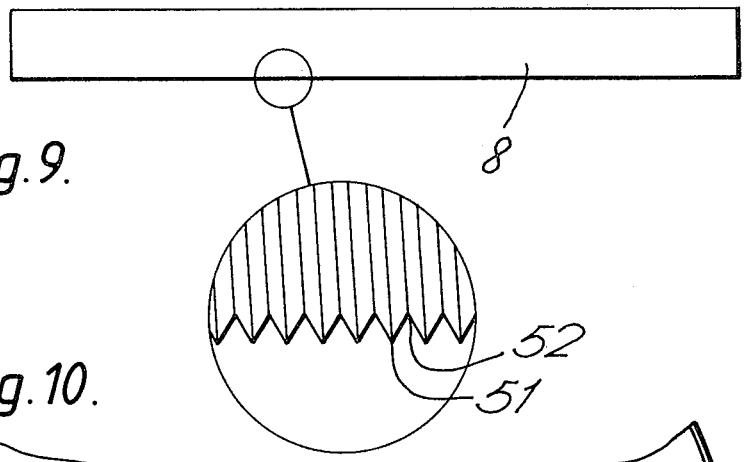
Fig. 9.
Fig. 10.
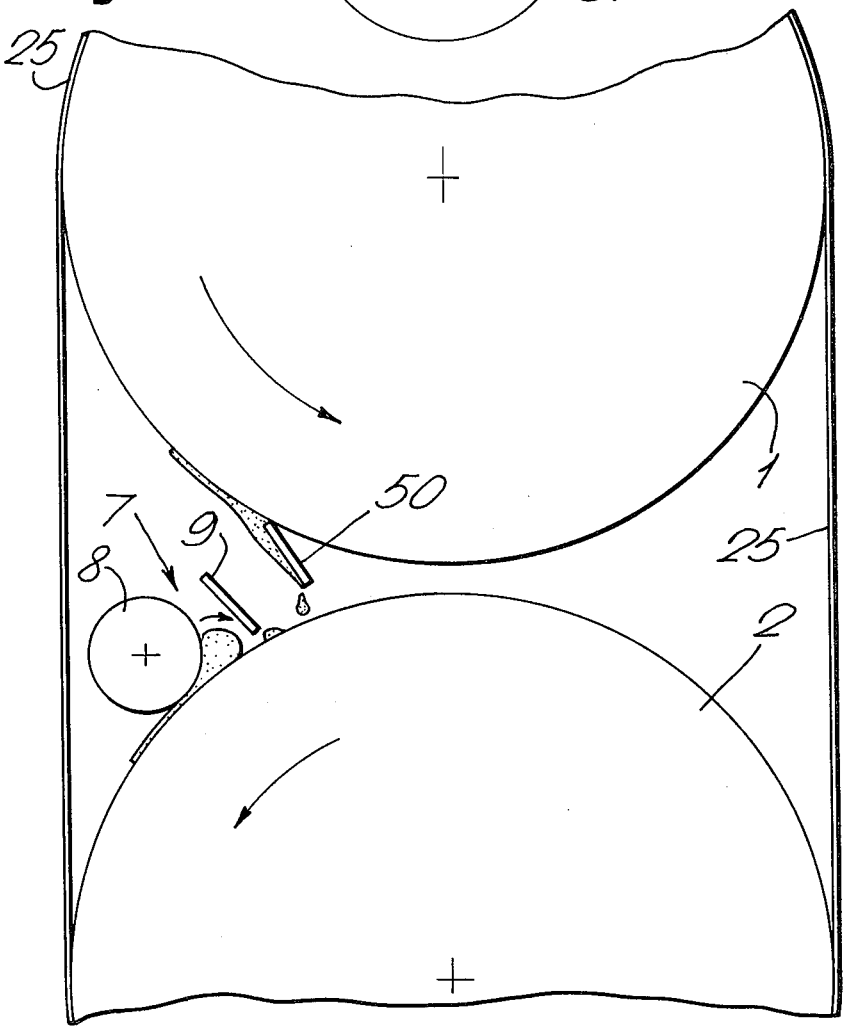

INK CONTROL FOR A MULTI-CYLINDER STENCIL DUPLICATOR

The present invention relates to a multi-cylinder stencil duplicator, and in particular to a multi-cylinder stencil duplicator incorporating means for automatically controlling the quantity of ink fed to the duplicating stencil in such a way that no compensation on the part of the operator is necessary to accommodate stencils having the image heavier than average.

Stencil duplicators conventionally come in two main types, the single cylinder or "drum" duplicator and the multi-cylinder (usually twin-cylinder) duplicator.

In the drum type of duplicator the stencil is mounted on the surface of a drum to which ink is applied from within. Usually the drum surface is covered with an ink pad which is absorbent to the ink and functions much in the way of a printing blanket to provide some resilient backing to the stencil. The ink applied internally of the drum passes out through holes in the drum surface and into the ink pad which provides a "buffer" of ink and allows lateral and longitudinal migration of the ink under the stencil away from the parts of the ink pad covering the inking holes in the drum surface and on to all parts of the stencil.

The multi-cylinder type of duplicator does not employ an ink pad for distributing the ink, but instead uses only a "silk" or ink screen which supports the stencil and is connected to drive bands around the cylinders of the machine. The ink is dispensed onto the surface of one of the stencil-carrying cylinders around which the stencil circulates in use of the duplicator, and is then rolled onto the stencil underside as the stencil passes over that cylinder.

It is an object of the present invention to provide a multi-cylinder stencil duplicator incorporating a fully automatic control requiring no compensation on the part of the operator to accommodate varying image densities.

The present invention provides a multi-cylinder stencil duplicator including first and second duplicator cylinders; a support for a stencil circulating around said first and second cylinders; a coating member positioned closely adjacent one of said first and second cylinders and defining therewith a nip for allowing an ink coating of predetermined thickness to pass through said nip on the surface of the said one cylinder; means for dispensing ink to one side of said nip such that during rotation of said one cylinder the ink is then passed directly through the nip for application as a uniform coating to the said one cylinder; and capacitive ink detector means responsive to the capacitance between two sensing electrodes at said one side of the nip, for controlling the operation of said ink dispensing means to maintain a given build-up of ink on the said one side of the nip. Preferably the surface of said one cylinder may be a said sensing electrode. Additionally or alternatively the surface of said coating member may be a said sensing electrode.

In order that the present invention may more readily be understood the following description is given, merely by way of example, with reference to the accompanying drawings, in which:

FIG. 9 is a side elevation of the coating member of FIG. 7;

FIG. 10 is a schematic view of a further embodiment of the first form of twin-cylinder duplicator.

Figure 1:
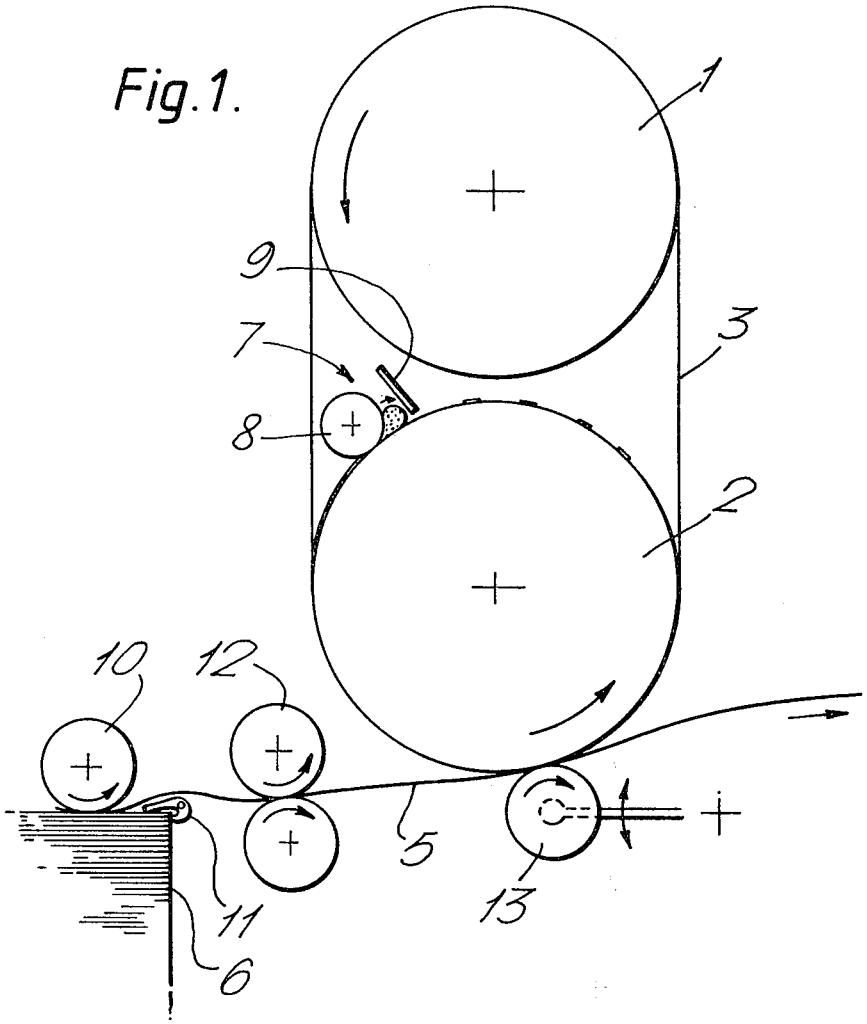
FIG. 1 is a schematic view of a stencil duplicator in accordance with the present invention.

FIG. 1 illustrates a twin-cylinder duplicator having a top cylinder 1 and a lower cylinder 2 with a stencil 3 entrained therearound. An inking unit 7 co-operates with the lower cylinder 2 and will be described in more detail with reference to FIGS. 5 to 9. The main function of the inking unit 7 is to provide a defined gap between an ink coating member 8 and the cylindrical surface of the lower duplicator cylinder 2 such that a predetermined thickness of ink is extruded onto the surface of the lower cylinder 2 along the full width of the duplicator (i.e. along the full length of the coating member 8). The quantity of ink held back by the coating member 8 (i.e. the size of a wedge of ink to the right of the nip between the coating member 8 and the lower duplicator cylinder 2) is automatically detected by means of a capacitive sensing system incorporating a sensing plate 9. A sensing circuit (not shown) is provided to detect changes in capacitance between the sensing plate 9 and the coating member 8 (which will for this purpose be electrically conductive) in response to the build-up of ink (shown in FIGS. 5 to 8) therebetween.

During rotation of the cylinders 1 and 2, copy sheets 5 from a feed stack 6 are fed by primary feed rollers 10 (upon release of the leading edge of the top copy sheet by a front stop 11) to secondary feed rollers 12 and then to the intermittently opening nip between a vertically driven impression roller 13 and the bottom cylinder 3 to pick up an ink image from the stencil 3.

Figure 2:
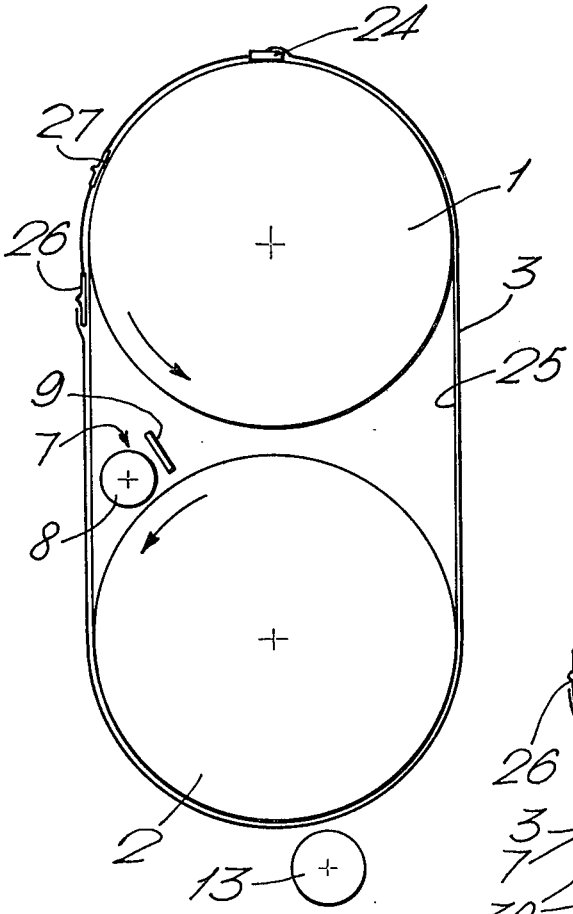
FIG. 2 is a schematic view of one embodiment of a first form of twin-cylinder duplicator in accordance with the present invention.

FIG. 2 shows one particular form of such a duplicator, and shows the stencil 3 carried by a mounting bar 24 and supported on an ink screen 25 which extends between the mounting bar 4 and a further bar 26 extending transversely between the drive bands (not shown) of the duplicator.

Figure 3:
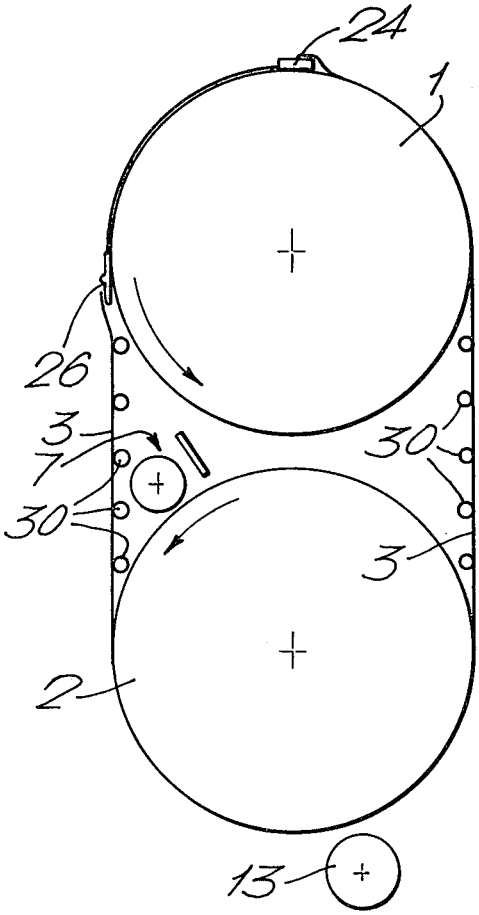
FIG. 3 is a schematic view of one embodiment of a second form of stencil duplicator in accordance with the present invention.

The alternative form shown in FIG. 3 includes a stencil heading bar 24 and the further bar 26, both extending transversely between the drive bands (not shown) of the duplicator, but in this case no separate ink screen is provided. Because, without the presence of an ink screen, the stencil 3 will tend to flap inwardly, particularly when the stencil tail is about to separate from one of the two cylinders 1 and 2 during operation of the duplicator, an array of hold-off rollers 30 is necessary to guide the stencil tail to follow accurately the desired "race-track" locus (defined by the ink screen in FIG. 2) so as to prevent the stencil dragging over the inking unit.

The inking unit 7 of FIG. 3 has the same general characteristics attributed to the inking unit 7 of FIGS. 1 and 2, and will be described in more detail with reference to FIGS. 5 to 9.

As suggested above, the drive bands (not shown) of the duplicator serve as a support for the ink screen in FIG. 2, and for the stencil heading bar 24 and a further bar 26 in both FIG. 2 and FIG. 3, and at the same time ensure synchronisation of the rotation of the two duplicator cylinders 1 and 2. The coating member 8 of each of the inking units shown schematically in FIGS. 1 to 3 is mounted at a fixed spacing from the surface of the lower duplicator cylinder 2, although it is envisaged that this spacing could be adjusted, and may even be set so that the spacing is wider at one end of the coating member 8 than at the other.

Figure 5:
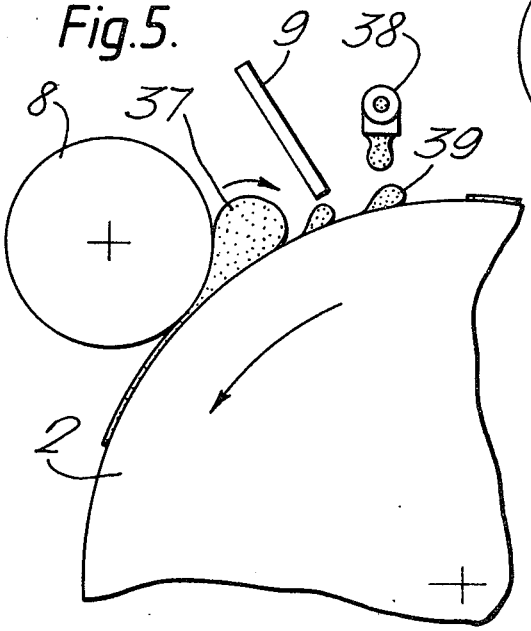
FIGS. 5, 6, 7 and 8 illustrate four different types of inking unit which can be used with either of the embodiments of duplicator shown in FIGS. 2 and 3.
Figure 6:
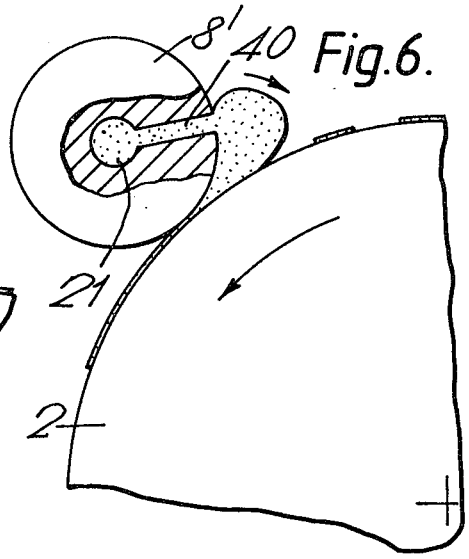

During rotation of the lower duplicator cylinder 2, ink on the surface of the cylinder 2 is thus extruded through the nip and equally a wedge of ink is held back ahead of the nip between the coating member 8 and the lower cylinder 2, provided of course ink is applied to the surface of the cylinder 2 by some suitable means such as 38 in FIG. 5 and 40 in FIG. 6.

With the conventional ink screen to support the stencil 3, the squeezing effect of the impression roller 13 which presses the copy paper into contact with the image-wise inked outer surface of the stencil 3 at the nip between the impression roller 13 and the lower cylinder 2 will tend to drive any ink, which does not pass through the stencil and into contact with the paper, along between the ink screen 25 and the stencil 3 towards the tail of the stencil. Provided, of course, there is image somewhere down the particular longitudinally extending region of the stencil under which this ink is travelling, the ink will eventually exude through the stencil and be transferred to the paper. However, with an asymmetrically imaged stencil it is possible for the ink in such a longitudinal region, where there is no or little image, to pass along the full length of the stencil and eventually to exude from under the tail of the stencil where it is flicked off the duplicator cylinder and contaminates nearby areas of the machine, apart from also constituting a waste of ink.

In accordance with the present invention we propose to avoid this continuous passage of ink to the tail of the stencil.

Figure 4:
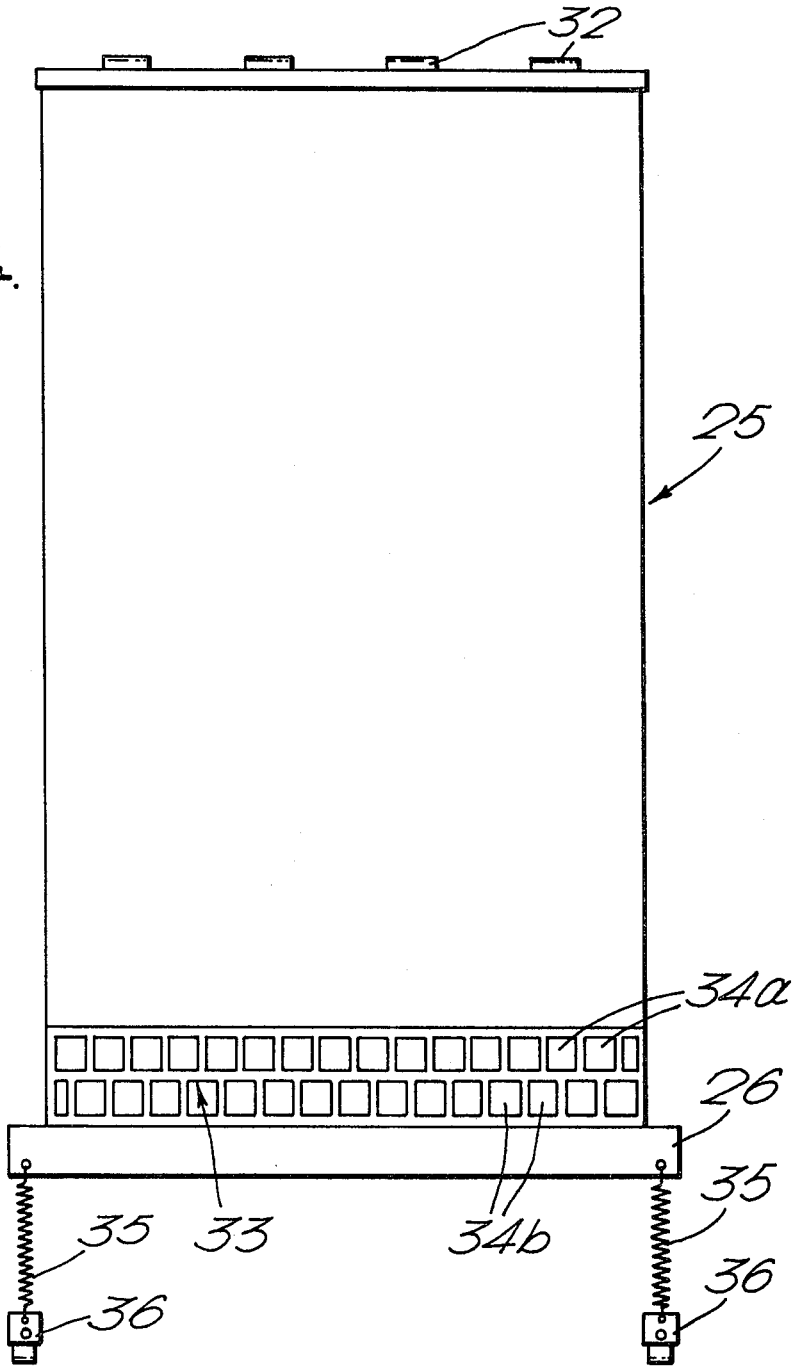
FIG. 4 is a schematic view of an ink screen for use with the duplicator of FIG. 2.

One way of achieving this result is to use the ink screen illustrated in FIG. 4 on the duplicator (for example the duplicator of FIG. 2).

The other way of achieving the same result is to incorporate the hold-off rollers 30 of FIG. 3 and to avoid the need for any ink screen whatsoever.

The ink-pervious ink screen shown in FIG. 4 has a mounting formation 32 at the end where it is to be fastened to the stencil heading bar 24 of the duplicator, and has near its other end a more readily ink-pervious area generally designated 33 which is positioned in registration with the tail of the stencil and is arranged such that the tail of the stencil conceals that area 33 in use of the duplicator. In this area 33 there are several apertures **34*a*, 34*b* which are each considerably greater than the overall mesh size of the ink screen 25, and which are in several rows (in this case two) such that the apertures 34*a* of one row are staggered with respect to the apertures 34*b* of another row. As a result of this staggering all lines in the image area of the ink screen (i.e. away from the extreme lateral margins) which are parallel to the longitudinal (vertical in FIG. 4) axis of the ink screen intersect at least one of the holes 34*a*, 34*b* and as a result ink squeezed along between the stencil and the ink screen towards the trailing end of the stencil is forced to find one of the apertures. Indeed, it is conceivable for the apertures to be so large in size that there may be a very small number indeed (in any case a much smaller number than is illustrated in the schematic view of FIG. 4**).

The tail end of the ink screen carries the further bar 26 (shown in FIG. 2) and tensioning springs 35 having at their ends clips 36 which are connected to another of the transverse bars (27 in FIG. 2) of the drive band assembly.

Using the ink screen of FIG. 4, the standard stencil length will always have its tail overlying the apertures **34*b* and consequently any ink which is squeezed towards the tail of the stencil will pass through an aperture 34*a*, 34*b*** back into contact with the upper or lower duplicator cylinder rather than exuding under the tail of the stencil and being flicked into the frame of the machine.

If such ink is transferred to the top cylinder 1 then of course the quantity on the top cylinder will increase and there will be a tendency for that ink quantity to re-transfer onto the ink screen and to arrive eventually back at the lower cylinder 2. Any ink returning to the lower cylinder 2 (at the 9 o'clock position as viewed in FIG. 2) will then pass round to the 3 o'clock position in FIG. 2 where the ink will tend to adhere to the surface of the lower cylinder 2 and travel upwardly and leftwardly towards the nip between the coating member 8 and the lower cylinder 2 to return to the reservoir wedge of ink in the nip.

With the "screenless" alternative form of duplicator shown in FIG. 3, the same action ensues except that instead of having to provide apertures **34*a*, 34*b* in the tail end of the ink screen 25, it is now possible to arrange for the ink to be transferred from under the stencil 3 onto either of the upper and lower cylinder 2 or onto the hold-off rollers 30, to be subsequently transferred to the cylinders 2 and 3**.

As mentioned above, the impression roller 13 is vertically driven. It will of course be appreciated that it moves cyclically into and out of contact with the stencil on the lower cylinder 2, in synchronisation with movement of the stencil heading bar 24. Consequently, the impression roller 13 only rises when a sheet of paper is present in the nip between the impression roller 13 and the lower duplicator cylinder 2, and it only remains up for long enough to press that sheet of paper against the stencil for the full length of the copy paper sheet.

In the event of a short sheet of paper going through the nip between the impression roller 13 and the lower cylinder 2, the image on the stencil will be correspondingly short so that any area of the stencil contacted by the impression roller near the tail of the stencil will be ink-impervious and no ink will be picked up by the impression roller 13. Furthermore, before the impression roller 13 contacts the extreme tail end of the stencil it will have been driven downwardly in order to release printing pressure. It is this contact which squeezes ink towards the tail of the stencil where there has been insufficient transfer of ink through the stencil onto the copy paper. With the ink screen 25 of FIG. 4 used with the duplicator of FIG. 2 such ink returns inwardly through the screen, and with the duplicator of FIG. 3 the ink fails to be squeezed along the full length of the stencil (by the separation of the impression roller 13 from the lower cylinder 2) and will generate near the tail of the stencil 3 a localised surplus of ink which will then pass inwardly.

Turning now to FIGS. 5, 6, 7 and 8, there are illustrated various different types of the inking unit 7 depicted schematically in FIGS. 1 to 3.

In FIG. 5, the coating member 8 is in the form of a rotatable roller which, together with the bottom cylinder 2, builds up a wedge 37 at the nip between the coating roller 8 and the bottom cylinder 2.

Because the nip between these two members 2 and 8 is of a fixed thickness (once it has been set either in the factory or subsequently during adjustment), the shear forces in the part of the ink wedge near its apex approaching the nip are high (but will of course depend upon the viscosity of the ink being used) and this has an effective agitating or "working" action to ensure that the ink which passes through the nip is uniformly applied as a flat layer and, in "working" the ink at this wedge apex the coating roller 8 has the effect of spreading the wedge 37 axially along the nip so that the entire width of the bottom cylinder 2 is coated with ink.

Although not illustrated in the drawings, it may be necessary to provide some form of end guide system to confine the ink layer to that part of the axial extent of the lower cylinder 2 over which the width of the stencil extends. In this way it is possible to avoid the flow of ink outwardly away from the centre of the lower cylinder 2 resulting in centrifugal flinging of the ink off the cylinder.

However, to some extent the fact that the build up of surplus ink passes back onto the duplicator cylinders 1,2 will avoid migration of ink laterally of the ink screen (axially of the duplicator cylinders).

Ink is applied to the surface of the lower cylinder 2 by a dispensing bar 38, in the form of drops 39 which, during anti-clockwise rotation of the lower cylinder 2, are fed into the "reservoir" wedge 37.

As mentioned above, measurement of the capacitance across the gap between the capacitive sensing plate 9 and the electrically conductive coating member (in this case metallic roller 8) provides an indication of the build-up of the wedge 37 because of the dielectric effect of the ink 37 in the gap between the two capacitance members 8 and 9.

A suitable form of the control circuit (see FIG. 11) will readily be envisaged by any expert skilled in this art and can provide a control signal responsive to the measured capacitance value. This circuit will be adjustable so that energisation of the ink supply means to the distributor bar 38 will commence when the magnitude of the wedge 37 drops below a certain "minimum" threshold, and will be stopped once the value exceeds a certain "maximum" threshold. Alternatively there may be a single threshold value below which the ink supply is started and above which the ink supply ceases.

Although in FIG. 5 the coating member is in the form of a freely rotatable electrically conductive roller 8 connected electrically to the sensing circuit, it could instead be in the form of a fixed cylinder having the configuration of member 8, or instead in the form of any other stationary member (for example a rectangular- or square-section bar) which is capable of doctoring the ink supply onto the lower cylinder 2 with the required degree of uniformity.

FIG. 6 shows an alternative type of inking unit in which the ink dispensing bar 38 has been replaced by a duct 40 extending radially of the coating member 8' which in this case is a stationary cylindrical member. Ink is introduced to the radially extending duct 40 by way of an axially extending duct 21 passing from one end of the coating member 8' towards the duct 40. It is envisaged that a single duct 40 halfway along the cylindrical coating member 8' will suffice. However, more than one such radially extending duct 40 connected to a single axially extending duct 21 may, if desired, be provided.

The type of inking unit shown in FIG. 6 works in the same way as the FIG. 5 type as regards the function of sensing the capacitance between the stationary cylindrical coating member 8' and the capacitive sensing electrode, except that in this case the sensing electrode is an electrically conductive surface of the lower cylinder 2 (either a surface coating on a dielectric cylinder 2 or the surface of an electrically conductive cylinder 2).

Figure 7:
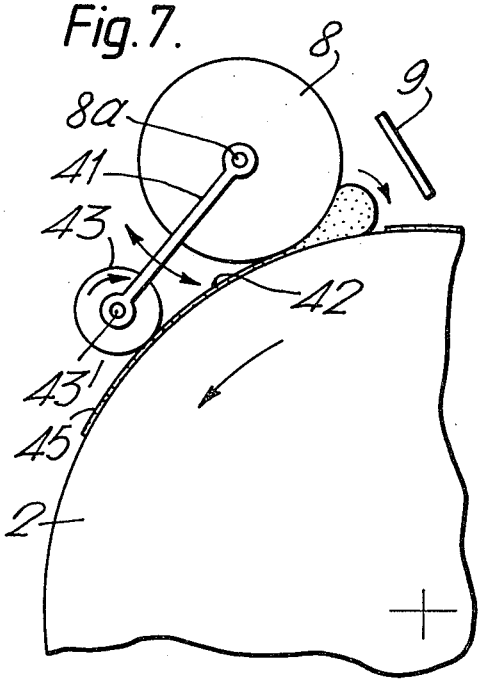

FIG. 7 shows yet a further possibility where, for example for reasons of promoting ink flow along the coating member 8 away from the centre thereof, the peripheral surface of the member 8 is provided with undulations (for example grooves shown in FIG. 9, which may in a preferred form comprise helical grooves of opposite hand extending outwardly away from the middle region of the coating member 8). This action of the grooves will pass relatively thick ink at the troughs 52 of the grooves through the nip between the coating member 8 and the lower cylinder 2, but the tips 51 between the grooves will generate undulations in the surface of the ink layer 42 metered onto the surface of cylinder 2. The smoothing roller 43 is supported on two arms 41 which are articulated to the axis of rotation 43' of the smoothing roller and the centre of curvature 8a of the coating member 8. Thus the smoothing roller presses on the undulating ink layer 42 and smoothes out the undulations to provide a coating 45 downstream of the smoothing roller which is free of undulations.

The coating member 8 in FIG. 7 may be either a rotating coating roller as in the FIG. 5 type, or a stationary cylindrical coating member as in the FIG. 6 type.

FIG. 7 again employs the plate 9 as one electrode, and the other electrode may be either the surface of the coating member 8 or the surface of the lower cylinder 2.

Figure 8:
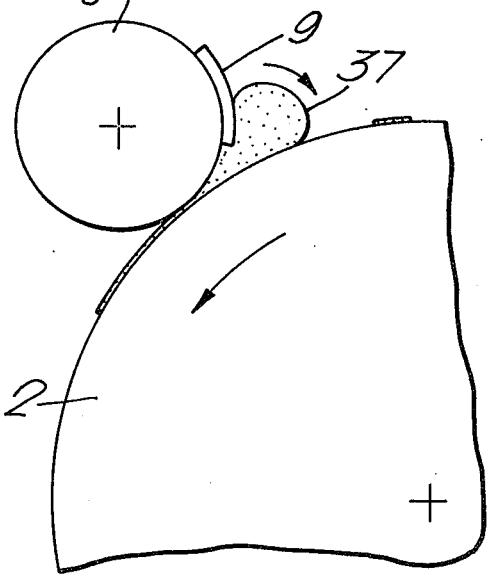

FIG. 8 shows a further alternative embodiment in which the coating roller 8 is of insulating material but is not rotatable and is provided in association with a fixed electrode 9 defining a portion of the cylindrical surface of the coating member 8. The other sensing electrode is again the surface of the lower cylinder 2 (either a conductive surface on an insulating cylinder, or the body of an electrically-conductive cylinder).

One important aspect of the present invention resides in the provision of capacitive ink detection in the wedge 37 upstream of the nip defined between the cylinder 2 and the coating member 8, preferably by using the coating member 8 and/or the cylinder 2 as electrically conductive member(s) of a "capacitor" assembly. Relying on the fact that a constant gap of the nip at any particular station axially along the lower duplicator cylinder 2 will provide a constant thickness coating of ink on the cylinder 2 with a held-back wedge 37 providing a "reservoir" effect which will extend along the full length of the coating member ensures that fully automatic, controlled application of ink to the cylinder 2 can be achieved.

Alternatively, the capacitive sensing system may employ two capacitor plates (one at each end of the coating member 8) and the capacitance value of the long gap therebetween may be monitored for controlling ink dispensing.

Another possibility is for the capacitive sensing system to employ one sensing plate arranged spaced from the surface of the cylinder 2 such that the wedge of ink is disposed between that plate and the surface of the duplicator cylinder 2, the latter forming the second electrode of the capacitive sensing system.

A further important aspect of the present invention resides in the appreciation that constant thickness application of ink to the cylinder 2 is acceptable even in the case of non-uniform image distribution across the width of the stencil, provided that there is not, between the cylinder 2 and the underside of the stencil ink screen, material constituting a relatively impervious barrier to hold the ink squeezed towards the tail of the stencil on the stencil underside. In one form of this aspect the ink screen is provided with apertures 34*a*, 34*b* shown in FIG. 4, and in the other form of this aspect no ink screen whatsoever is provided, but alternative means such as the optional hold-off rollers 30 may be incorporated.

Although it is envisaged that the apparatus illustrated in FIGS. 1, 2, 3 and 5 to 8 is quite capable of controlling ink thickness on not only the bottom cylinder 2 where ink is metered from the "reservoir" wedge 37 but also on the top cylinder 1 to which it is carried on the back of the ink screen in the FIG. 2 embodiment along the back of the stencil itself in the FIG. 3 embodiment, it may be advantageous to incorporate an optional scraper blade 50 (FIG. 10) on the top cylinder, for example where shown (i.e. in the lower two quadrants of that cylinder where the surface of the cylinder is exposed).

With the second aspect of the invention, any detecting system such as resistive detection, mechanical detection, optical detection, or inductive detection can be used in place of the capacitive detection described and illustrated.

Figure 11:
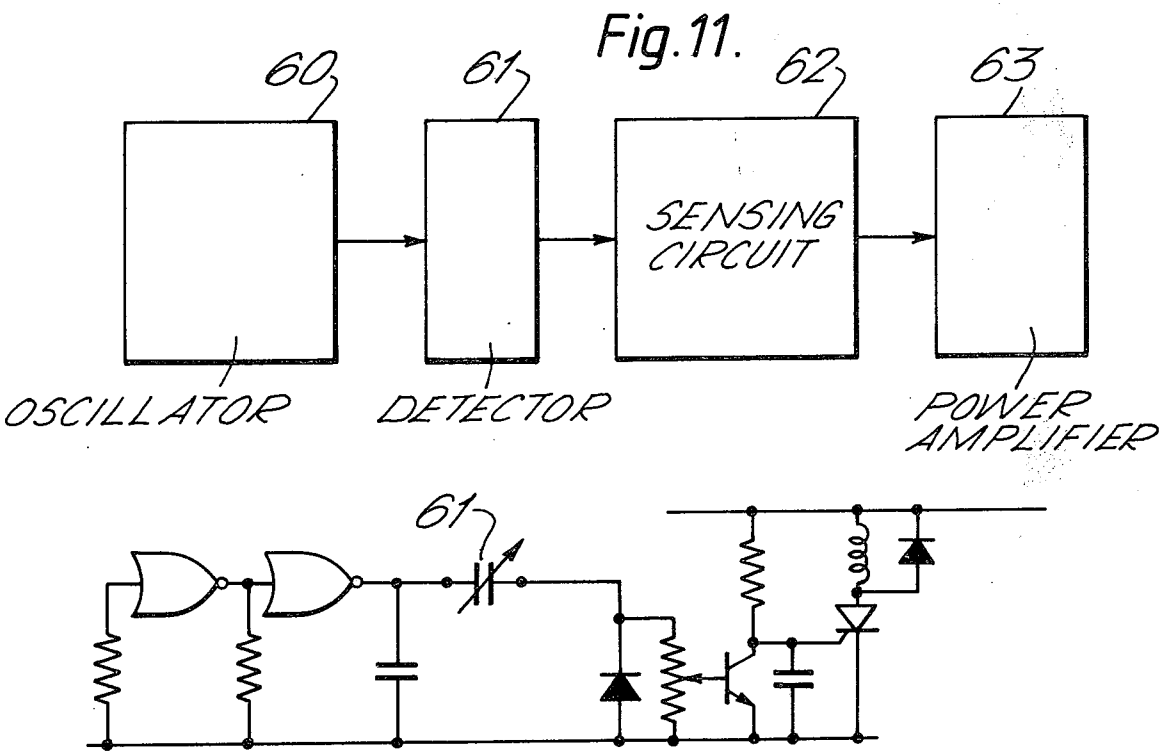
FIG. 11 is a schematic view of control circuitry for the inking unit of FIGS. 5, 6, 7 or 8.

FIG. 11 shows a block diagram of the control circuitry comprising an oscillator 60 applying an oscillating signal across the electrodes of the capacitive detector 61. In practice these "electrodes" can comprise on the one hand a surface of the coating member 8 and, on the other hand the cylinder 2 running parallel thereto across the duplicator. The oscillating signal, modified by the quantity of ink between the electrodes of the detector 61 then passes to a sensing circuit 62 whose output is applied to the power amplifier 63 to generate a control signal for the ink supplying means. The lower part of FIG. 1 shows one possible embodiment of actual circuitry giving the block diagram elements shown in the upper part of FIG. 1. In this circuitry the detector 61 appears as the variable capacitance.

Although the inking unit disclosed above is capable of use with many kinds of multi-cylinder stencil duplicator, it is particularly convenient with one where the apertures are provided in the part of the ink screen coming into register with the tail of the stencil, or with an ink screen in which the permeability to ink is greater at that part, because then all surplus ink will pass back onto the cylinders and return to the wedge in front of the coating bar, thereby ensuring that the quantity of ink in the wedge is an accurate reflection of the amount of ink in the entire system comprising the two duplicator cylinders and the ink screen. If surplus ink is allowed to stagnate between the ink screen and the stencil, this ink is not detected by the capacitive sensing system associated with the inking unit and consequently the possibility of over inking is greater.

As will be appreciated from the above, the compensation for lack of uniformity of inking works both in the case of an image which is dense at one end of the stencil and not at the other (for example in the case of an image intended for a short sheet of paper) as well as for lateral non-uniformity, and will of course accommodate any combination of these two phenomena.

If desired, the tail end of the ink screen (the bottom in FIG. 4) beyond the apertures 34*a*, 34*b* may be coated to render it ink-impervious, in order to assist in preventing the underside of the stencil tail from being excessively inked.

We claim:

1. A multi-cylinder stencil duplicator comprising:

(a) first and second cylinders;

(b) stencil support means for a stencil circulating around said first and second cylinders;

(c) a non-oscillating ink coating member positioned closely adjacent said first cylinder and defining therewith a nip for allowing an ink coating of predetermined substantially uniform thickness to pass through said nip on the surface of the said first cylinder;

(d) means for dispensing ink to a location on said first cylinder to one side of said nip such that during rotation of said first cylinder the ink is then passed directly through the nip for application as said substantially uniform coating to the said first cylinder;

(e) capacitive ink detector means, responsive to the electrical capacitance across the ink at said one side of the nip, for use in controlling the operation of said ink dispensing means to maintain a given build-up of ink on the said one side of the nip, said capacitive ink detector means comprising: first and second spaced elongate electrodes extending the length of said first cylinder and positioned with said build-up of the ink at said one side of said nip between said first and second elongate electrodes, and means for detecting the electrical capacitance between said first and second elongate electrodes along the length of said nip; and (f) control means operatively connecting said capactive ink detector means and said ink dispensing means for controlling said ink dispensing means to operate in response to depletion of said ink build-up at said one side of said nip.

2. A multi-cylinder stencil duplicator according to claim 1, wherein said first electrode comprises an electrically conductive surface of said first cylinder.

3. A multi-cylinder stencil duplicator according to claim 1, wherein said first electrode comprises an electrically conductive surface of said coating member.

4. A multi-cylinder stencil duplicator according to claim 3, wherein said coating member has a non-conductive body and an electrically conductive surface region defining said electrode.

5. A multi-cylinder stencil duplicator according to claim 1, wherein said coating member has a non-conductive body and a metallic electrically conductive surface portion, said first electrode comprises an electrically conductive surface of said first cylinder and said second electrode comprises said metallic conductive surface portion of said coating member.

6. A stencil duplicator according to any one of claims 1 to 5, wherein said ink-dispensing means includes a member separate from said coating member and mounted adjacent thereto in an upstream position with respect to the direction of normal rotation of said first cylinder.

7. A duplicator according to any one of claims 1 to 5, wherein said coating member comprises a stationary member of cylindrical cross-section adjacent the said first cylinder.

8. A stencil duplicator according to claim 7, wherein said ink dispensing means comprises means for introducing ink to the surface of said coating member from the interior.

9. A duplicator according to any one of claims 1 to 5, wherein said coating member comprises a freely rotatable roller.

10. A stencil duplicator according to claim 9, wherein the coating member has an undulating periphery and smoothing means are provided for smoothing resulting undulations from the ink coating applied to the first cylinder through said nip.

11. A duplicator according to claim 10, including means defining at least one groove on the periphery of the coating member to form the undulating periphery, and wherein said smoothing means comprise (a) a smoothing roller positioned downstream of the nip between the coating member and the one cylinder and (b) means biasing said smoothing roller towards the said first cylinder.

12. A stencil duplicator according to claim 11, wherein said coating member has a central region and there are first and second said grooves extending helically outwardly away from the central region towards the ends of said coating member, said first groove extending in one direction away from the central region and being of a first hand and said second groove extending in the opposite direction being of opposite hand to the first groove.

13. A duplicator according to claim 11, including arms articulated at the centre of curvature of the cylindrical coating member and supporting the ends of the smoothing roller to carry the smoothing roller for movement towards and away from said first cylinder.

14. A duplicator according to claim 11, wherein said means biasing the smoothing roller towards the surface of said first cylinder comprise spring biasing means.

15. A duplicator according to any one of claims 1 to 5, and including a doctoring member co-operating with the surface of the second cylinder for smoothing ink on that surface.

16. A multi-cylinder stencil duplicator comprising:

(a) a first cylinder having an electrically conductive surface;

(b) a second cylinder parallel to said first cylinder;

(c) stencil support means for a stencil circulating around said first and second cylinders;

(d) an ink coating member positioned closely adjacent said first cylinder and defining therewith a nip for allowing an ink coating of predetermined thickness to pass through said nip on the surface of the said first cylinder, said ink coating member having a non-conductive body and a metallic electrically conductive surface portion;

(e) means for dispensing ink to a location on said first cylinder to one side of said nip such that during rotation of said first cylinder the ink is then passed directly through the nip for application as a uniform coating to the said first cylinder;

(f) capacitive ink detector means, responsive to the electrical capacitance across the ink at said one side of the nip, for use in controlling the operation of said ink dispensing means to maintain a given build-up of ink on the said one side of the nip, said capacitive ink detector means comprising: first and second spaced electrodes positioned with said build-up of the ink between said electrodes, and means for detecting the electrical capacitance between said first and second electrodes, said first electrodes comprising said electrically conductive surface of said first cylinder and said second electrode comprising said metallic conductive surface portion of said coating member;

(g) control means operatively connecting said capacitive ink detector means and said ink dispensing means for controlling said ink dispensing means to operate in response to depletion of said ink build-up at said one side of said nip.

17. A stencil duplicator according to claim 16, wherein said ink-dispensing means includes a member separate from said coating member and mounted adjacent thereto in an upstream position with respect to the direction of normal rotation of said first cylinder.

18. A duplicator according to claim 16, and including a doctoring member co-operating with the surface of the second cylinder for smoothing ink on that surface.

* * * * *